US005385277A

United States Patent [19]

Drew et al.

[11] Patent Number: 5,385,277

[45] Date of Patent: Jan. 31, 1995

[54] CARBONATED BEVERAGE BOTTLE HANDLE, POUR AND STORAGE DEVICE

[75] Inventors: Robert E. Drew, Kenilworth; David M. Drew, Glenview; Steve Kraus, Chicago, all of Ill.

[73] Assignee: Innovative Consumer Products, Inc., Highland Park, Ill.

[21] Appl. No.: 91,592

[22] Filed: Jul. 14, 1993

[51] Int. Cl.[6] ..... A47G 19/12; B65D 23/10

[52] U.S. Cl. ..... 222/474; 294/27.1

[58] Field of Search ..... 294/27.1–33; 215/228, 235, 239, 240, 270, 271, 273, 274, 276, 100 R, 100 A, 101; 220/212.5, 737, 740, 752, 758, 759, 769; 222/465.1, 469–475, 491, 494, 505, 556

[56] References Cited

U.S. PATENT DOCUMENTS

| | | | |
|---|---|---|---|
| 2,746,632 | 5/1956 | Bramming | 215/270 |
| 3,201,011 | 8/1965 | Brocken | 222/473 |
| 3,321,115 | 5/1967 | Rendahl | 222/473 X |
| 3,384,275 | 5/1968 | Simms | 222/474 |
| 3,415,405 | 12/1968 | Rausing et al. | 215/270 X |
| 3,672,527 | 6/1972 | Bly | 215/270 X |
| 3,799,408 | 3/1974 | Palmer | 222/474 |
| 4,456,135 | 6/1984 | Beekes | 294/27.1 X |
| 4,714,167 | 12/1987 | Sandhaus | 215/270 |
| 4,901,874 | 2/1990 | Glazer | 215/270 X |

FOREIGN PATENT DOCUMENTS

| | | | |
|---|---|---|---|
| 1138982 | 6/1957 | France | 215/271 |
| 1529141 | 10/1978 | United Kingdom | 222/475.1 |

*Primary Examiner*—Johnny D. Cherry
*Attorney, Agent, or Firm*—Allegretti & Witcoff, Ltd.

[57] ABSTRACT

A carbonated beverage bottle handle, pour and storage device comprises bottle top, flapper, handle and actuator portions. The bottle top portion defines a spout screwed to a bottle. The handle portion is fixed to the bottle top portion, and is gripped for holding a bottle. The actuator portion is squeezable toward the handle portion. The flapper portion is joined to the actuator portion and positioned over the spout to be lifted to and from the bottle top portion, to allow liquid to be poured. A stopper is attached to the flapper portion such that lifting the flapper portion lifts the stopper, opening the top of the attached bottle. A screw-threaded, segmented collar welded in the bottle top portion forms female threads for screwing to the bottle. The stopper includes a dome and an annular outer wall, and defines an interior within the annular outer wall. The dome and all of the stopper are formed of material which is flexible in the range of pressures exerted by carbonated beverages. The dome is integrated into the outer wall. As a result of composition and configuration, the dome flexes under action of beverage pressure, exerting outward pressure on the stopper outer wall. The outer wall has a clearance fit within the top of an attached bottle. Under action of outward pressure on the outer wall, exerted by the dome under pressure of a beverage, the outer wall increases the effectiveness of the stopper within the top of the beverage bottle.

2 Claims, 2 Drawing Sheets

CARBONATED BEVERAGE BOTTLE HANDLE, POUR AND STORAGE DEVICE

BACKGROUND OF THE INVENTION

This invention relates to closures for screw top bottles such as soda or pop bottles, and more particularly, to resealable closures for such bottles.

Screw-top bottles are now in common use for delivery of carbonated beverages to consumers. Such bottles are formed of highly flexible plastic in one and two liter sizes. The bottles include tops or necks with screw-threaded openings. After opening and pouring of portions of the bottle contents, the bottles become hard to handle.

Many devices provide handles for bottles and other containers. Coffee pots have handles attached to collars around the necks of the pots. Pancake syrup containers have similar handles. Clearly, attachment of a handle to a carbonated beverage container presents no obstacle of engineering. As obvious, a handle can be attached to a collar which screws onto the bottle. Further, as obvious, the handle and collar can include a lever-actuated cover for replacing the original bottle top and providing for opening and closing of the bottle with the handle and collar in place. If preferred, the handle, collar and cover may include a lock such as a locking pin as often used in power tools such as power drills and power saws, as often used on screen doors, and as often used in guns and toys, to lock the cover closed.

An aspect of handled devices for carbonated beverage bottles which creates a difficult situation is the aspect of providing a movable bottle stopper which effectively seals the bottle against beverage pressure. Carbonated beverages "go flat" over time, through escape of the carbonating gas from the liquid of the beverage. The escape of gas creates pressure in the beverage bottle. In shipment of the bottle to the consumer, the pressure in the bottle is met by the force of the screw threads which hold the cap to the bottle. In the provision of a moving bottle stopper in association with a bottle handle device, the pressure in the bottle must be met, while at the same time, the stopper must be readily movable.

SUMMARY OF THE INVENTION

An object of the invention is the provision of a carbonated beverage bottle handle, pour and storage device which incorporates a movable stopper and also meets the pressure of the carbonated beverage with an effective seal.

Another object of the invention is the provision of a carbonated beverage bottle handle, pour and storage device which is economical of manufacture, re-usable, and long lasting.

These and other objects and advantages are most fully appreciated with a complete understanding of the preferred embodiment of the invention in the context of the art. Yet in summary, the invented closure and handle device comprises a bottle top portion, a flapper portion, a handle portion, and an actuator portion. The bottle top portion defines a spout and is configured to be screwed to a screw-top bottle. The handle portion is fixed to the bottle top portion, and is configured to be gripped for holding a bottle to which the device is attached. The actuator portion is mounted to be squeezable toward the handle portion. The flapper portion is joined to the actuator portion and positioned over the spout to be lifted to and from the bottle top portion, to allow liquid to be poured from the spout of the bottle top portion. A screw-threaded, segmented collar welded in the bottle top portion forms female threads for screwing to the bottle.

The device further comprises a stopper means for sealing the top of the bottle to which the device is attached. The stopper means (hereafter "the stopper") is attached to the flapper portion such that lifting of the flapper portion lifts the stopper, opening the top of the attached bottle. The top of the bottle is annular and circular in cross section and defines a bottle top centerline. The stopper has a centerline which is substantially co-linear with the bottle top centerline.

The stopper includes a dome and an annular outer wall, and defines an interior within the annular outer wall. The dome spans across the interior of the outer wall and presents a domed surface to the interior of a bottle to which the device is attached. The dome is also domed in that except as supported by the outer wall, the dome is self-supporting. The dome is symmetrical about the central axis, and the outer wall is symmetrical about the central axis. The outer wall is also annular about the central axis, and the dome extends generally in a plane transverse to the central axis. The dome and all of the stopper are formed of material which is flexible in the range of pressures exerted by carbonated beverages in a full or partially filled bottle. The periphery of the dome is directly connected and integrated into the outer wall. As a result of composition and configuration, the dome flexes under action of beverage pressure, itself exerting outward pressure on the stopper outer wall. The outer wall has an exterior diameter having a clearance fit within the top of an attached bottle, the exterior diameter being sized to equal the interior diameter of the top of the attached bottle, less a clearance amount. The outer wall, under action of outward pressure on the outer wall, exerted by the dome under pressure of a beverage, increases the effectiveness of the stopper within the top of the beverage bottle.

Attention is now directed to the preferred embodiment.

BRIEF DESCRIPTION OF THE DRAWING

The preferred embodiment of the invention will be described hereafter, in relation to the accompanying drawing. For ease of orientation to the drawing, the views of the drawing are briefly described as follows.

DETAILED DESCRIPTION OF THE PREFERRED EMBODIMENT

Figure 1:
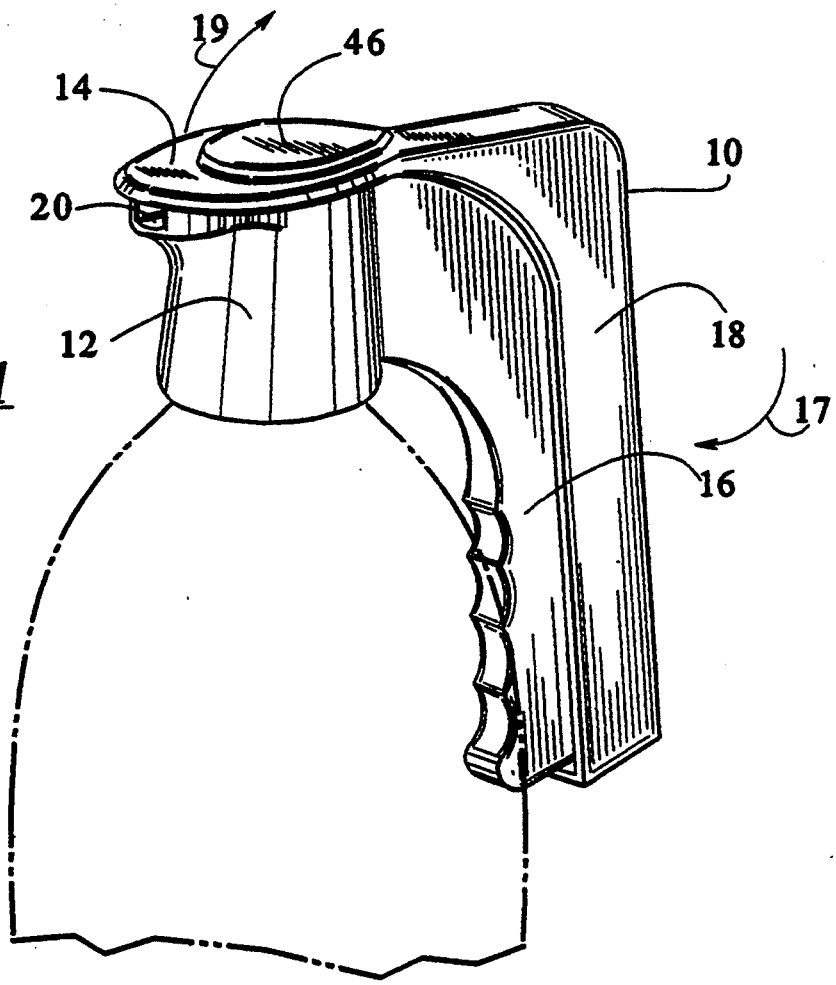
FIG. 1 is a perspective view of the preferred closure and handle device of the invention.
Figure 2:
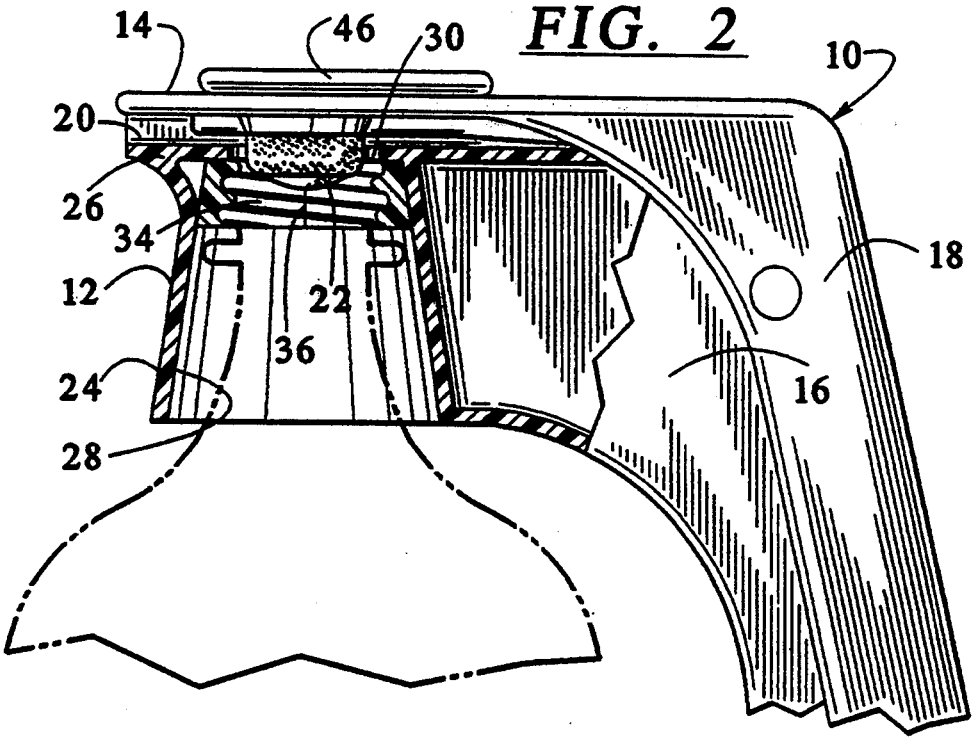
FIG. 2 is a side elevation view of the preferred closure and handle device of the invention, with the bottle top portion of the device broken away along the vertical centerline of the device to reveal internal detail.

Referring to FIG. 1, the preferred embodiment of the invented closure and handle device, generally designated 10, includes a bottle top portion 12, a flapper portion 14, a handle portion 16, and an actuator portion 18. The bottle top portion is, in use, screwed to a screw-top bottle such as a pop or soda bottle, as shown in dashed outline in FIGS. 1 and 2. The handle portion 16 is fixed to the bottle top portion 12, and may be gripped for holding the bottle to which the device is attached. The actuator portion 18 may be squeezed toward the handle portion 16, see arrow 17, to lift the flapper portion 14 from the bottle top portion 12, as by obvious lever action as noted above, see arrow 19, to allow liquid to be poured from the spout 20 of the bottle top portion 12. As shown in FIG. 2, a stopper 22 seals the top of the bottle to which the device 10 is attached.

Continuing to refer to FIG. 2, the stopper 22 is attached to the flapper portion 14 of the device. Lifting the flapper portion 14 lifts the stopper 22, opening the top of any bottle. The top of the bottle is annular, and circular in cross section. In a typical orientation of the bottle, the centerline of the top of the bottle is vertical, and the top is circular in horizontal cross-section. Using the centerline of the bottle top as a spatial reference, the stopper 22 has a centerline which is substantially co-linear with the centerline of the bottle top. The stopper 22 is circular is cross-sections perpendicular to the centerline. When the flapper 14 is not lifted, the stopper 22 extends into the top of the bottle in contact with the sidewalls of the top of the bottle, to seal the bottle. When the flapper 14 is lifted, the stopper is lifted from the bottle top.

Referring again to FIG. 2, the bottle top portion 12 of the device 10 includes a skirt portion 24 which is frusto-conical about a centerline aligned with the centerline of the top of the bottle. At the narrower end of the skirt 24, which is the upper end in FIG. 2, the skirt 24 merges into a spout portion 26. The skirt 24 defines an internal space 28 which is frusto-conical, and which has a narrow-end diameter. The spout portion 26 defines a circular opening 30 with a center which is aligned with the centerline of the internal space 28. The opening 30 has a diameter called the opening diameter which is smaller than the narrow end diameter of the skirt 24 and larger than the diameter of the stopper 22.

Figure 6:
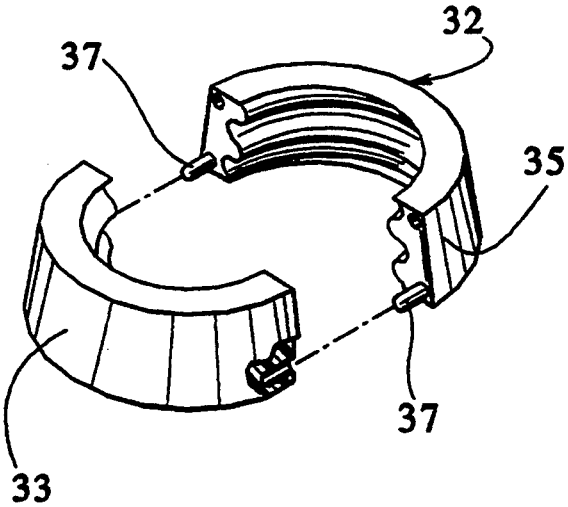
FIG. 6 is a perspective view of the preferred collar of the preferred closure and handle device.

Referring to FIGS. 2 and 6, screw threads for engaging the top of the bottle are formed in a segmented collar 32. The collar 32 is annular, and forms female threads along the inner, annular surface 34. The collar includes two halves 33, 35, as best shown in FIG. 6, joined along joint lines which are parallel to the collar centerline. A typical joint line is line 36. Pins 37 of one half extend into pin openings, such as opening 41, in the other half, to align the halves. The collar is, thus, individually formed, preferably by molding, apart from the remainder of the device.

As shown in FIG. 2, the collar 32 is snugged against the ledge formed at the juncture of the skirt and spout portions 24, 26 of the device bottle top portion 12. All portions 12, 14, 16, 18 of the device are preferably plastic, as is the collar 32. The collar segments are plastic welded together, and to the device portion 12.

Figure 3:
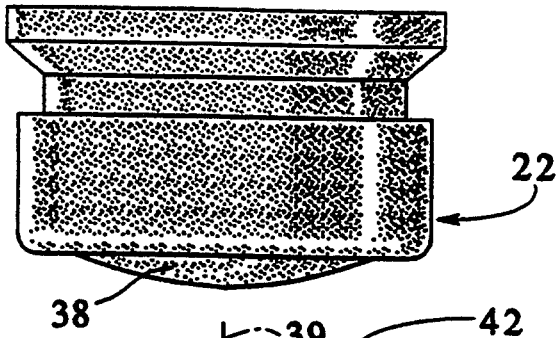
FIG. 3 is a side elevation view of the preferred bottle stopper of the preferred closure and handle device.
Figure 4:
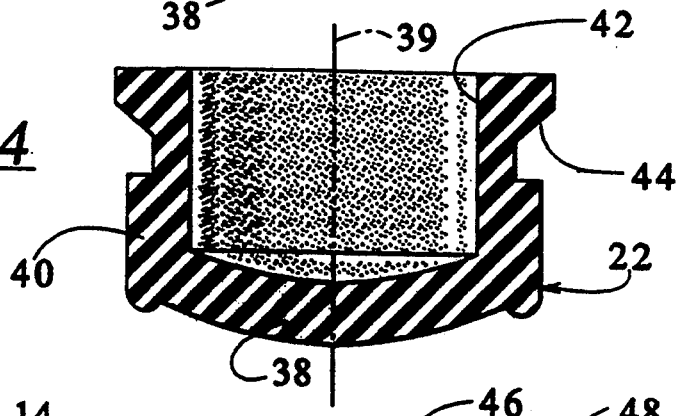
FIG. 4 is a cross-sectional view of the preferred stopper, taken along the vertical centerline of the stopper.
Figure 5:
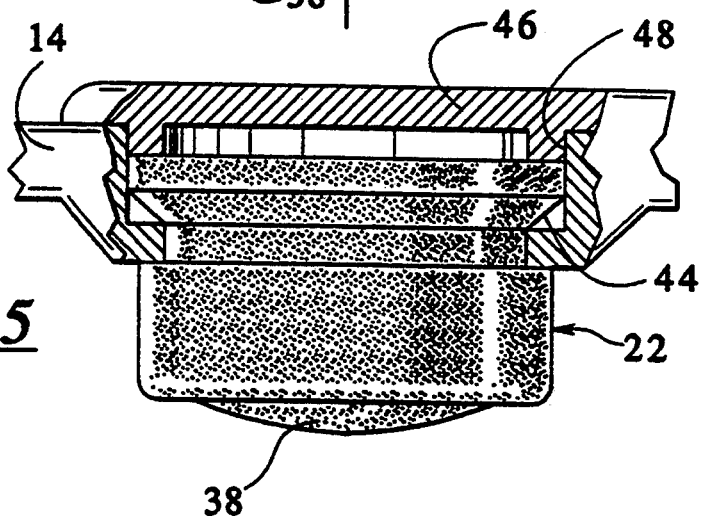
FIG. 5 is a side elevation view of the preferred stopper, similar to FIG. 3, with the preferred stopper in situ in the preferred closure and handle device, with the flap portion of the device broken away along the vertical centerline of the device to reveal internal detail.

Referring to FIGS. 3, 4 and 5, the stopper 22 has a unique configuration, and a unique relationship to the device flapper portion 14. In an important aspect, the stopper 22 includes a dome 38. The dome 38 is domed in that it spans across the interior of a substantially circular outer wall 40 and presents a domed surface to the interior of a bottle to which the device 10 is attached. The dome 38 is also domed in that except as supported by the outer wall 40, the dome 38 is self-supporting. No member extends within the interior 42 of the stopper 22 into contact with the dome 38.

The dome 38 is symmetrical about a central axis 39, as is the outer wall 40. The outer wall 40 is also annular about the axis 39, and the dome 38 extends generally in a plane transverse to the axis 39.

The dome 38, and all of the stopper 22, is formed of material which is flexible in the range of pressures exerted by carbonated beverages. The periphery of the dome is directly connected and integrated into the outer wall 40. As a result of composition and configuration, the dome 38 flexes under action of beverage pressure, itself exerting outward pressure on the stopper outer wall 40. The outer wall 40 is annular as stated above, and has an exterior diameter having a clearance fit within the top of an attached bottle; the exterior diameter is sized to equal the interior diameter of the top of the attached bottle, less a clearance amount.

Under action of outward pressure on the outer wall 40, exerted by the dome 38 under pressure of a beverage, the outer wall 40 increases the effectiveness of the stopper 22 within the top of the beverage bottle.

Referring again to FIGS. 3 and 4, the stopper 22 is completed with a flange portion 44. As shown in FIG. 5, the flange portion 44 retains the stopper 22 in the flapper portion 14, with a cover 46 placed over the opening 48 into which the stopper 22 is placed.

The preferred embodiment of the invention is now described in such full, clear and concise manner as to allow a person of ordinary skill in the art to make and use the same. Modifications can be made to the structure and functions of the preferred embodiment without departing from the scope of the invention. Because modifications are possible, the following claims conclude this specification, to particularly point out and distinctly claim the subject matter regarded as invention.

What is claimed is:

1. In a closure and handle device comprising a bottle top portion, a flapper portion, a handle portion, and an actuator portion, the bottle top portion defining a spout and having female threads configured to be screwed to a screw-top bottle, the handle portion fixed to the bottle top portion, and having a grip lever to be gripped for holding a bottle to which the device is attached, the actuator portion mounted to the handle portion to be squeezable toward the handle portion, the flapper portion joined to the actuator portion and positioned over the spout to be lifted to and from the bottle top portion, to allow liquid to be poured from the spout of the bottle top portion, a stopper means for sealing the top of the bottle to which the device is attached, the stopper means including a stopper attached to the flapper portion such that lifting of the flapper portion lifts the stopper, opening the top of the attached bottle, the top of the bottle being annular and circular in cross section and defining a bottle top centerline, the stopper having a centerline which is substantially co-linear with the bottle top centerline, the stopper including a dome and an annular outer wall, and defining an interior within the annular outer wall, the dome spanning across the interior of the outer wall and presenting a domed surface to the interior of a bottle to which the device is attached, the dome being symmetrical about the stopper centerline, and the outer wall being symmetrical about the stopper centerline, the outer wall also being annular about the stopper centerline, and the dome extending generally in a plane transverse to the stopper centerline, the dome and all of the stopper being formed of material which is flexible in the range of pressures exerted by carbonated beverages, the periphery of the dome being directly connected and integrated into the outer wall, as a result of composition and configuration, the dome flexing under action of beverage pressure, itself exerting outward pressure on the stopper outer wall, the outer wall having an exterior diameter having a clearance fit within the top of an attached bottle, the outer wall, under action of outward pressure on the outer wall, exerted by the dome under pressure of a beverage, flexing and exerting outward pressure within the top of the attached bottle, thereby increasing the effectiveness of the stopper within the top of the beverage bottle.

2. In a closure and handle device comprising a bottle top portion, a flapper portion, a handle portion, and an actuator portion, the bottle top portion defining a spout and having female threads to be screwed to a screw-top bottle, the handle portion fixed to the bottle top portion, and having a grip to be gripped for holding a bottle to which the device is attached, the actuator portion mounted to the handle portion to be squeezable toward the handle portion, the flapper portion joined to the actuator portion and positioned over the spout to be lifted to and from the bottle top portion, to allow liquid to be poured from the spout of the bottle top portion, and a stopper means for sealing the top of the bottle to which the device is attached, the stopper means being attached to the flapper portion such that lifting of the flapper portion lifts the stopper means, opening the top of the attached bottle, the top of the bottle being annular and circular in cross section and defining a bottle top centerline, the improvement comprising a segmented collar forming the female threads for screwing to the bottle top, the collar being individually formed apart from the device and thereafter joined to the bottle top portion, the collar having a centerline which is substantially co-linear with the bottle top centerline.

* * * * *